United States Patent [19]

D'Alo

[11] 4,168,024

[45] Sep. 18, 1979

[54] POLYSTYRENE CARRIER

[75] Inventor: Herbert F. D'Alo, Lakewood, Ill.

[73] Assignee: Abbott Laboratories, North Chicago, Ill.

[21] Appl. No.: 876,776

[22] Filed: Feb. 10, 1978

[51] Int. Cl.[2] ..... B65D 71/00

[52] U.S. Cl. ..... 224/45 P; 206/45.34; 220/94 R

[58] Field of Search ..... 224/45 P, 45 R, 5 H; 206/45.31, 45.34, 803; 220/94 R, 94 A, 96; 16/110.5, 125; 190/58 A

[56] References Cited

U.S. PATENT DOCUMENTS

| | | | |
|---|---|---|---|
| 487,688 | 12/1892 | Wood et al. | 220/96 |
| 3,275,366 | 9/1966 | Hidding | 220/94 R |
| 3,324,997 | 6/1967 | Bonanno | 206/45.34 |
| 3,412,887 | 11/1968 | Swartwood et al. | 220/94 R |
| 3,420,361 | 1/1969 | Newberg | 206/45.34 |
| 3,524,564 | 8/1970 | Schurman | 206/45.34 |

*Primary Examiner*—Robert J. Spar
*Assistant Examiner*—Kenneth Noland
*Attorney, Agent, or Firm*—Robert L. Niblack; Aaron L. Hardt

[57] ABSTRACT

Carrier comprising a unitary polystyrene container having posts extending divergently out from the container in nonvertical directions and a carrying strap or handle affixed to each post substantially perpendicular to the axis thereof. The carrier is useful as an emergency medical kit.

5 Claims, 10 Drawing Figures

POLYSTYRENE CARRIER

BACKGROUND OF THE INVENTION

The present invention relates to carriers comprising a container and carrying strap or handle and, more particularly, to such carriers made of expanded rigid polystyrene plastic. A preferred embodiment of the invention relates to its use as an emergency medical kit.

Carriers have long been known and made of a great variety of materials. Carriers made of expended rigid polystyrene plastic have also been known for some time, but it has always been necessary to provide such polystyrene carriers with nonpolystyrenic posts adapted for receipt of a carrying strap or handle. That is, due to the relatively poor tensile strength of polystyrene, lifting the prior art polystyrene carriers by a carrying strap or handle affixed to a polystyrene post molded thereon would generally peel at least a portion of the posts from the carrier and allow the strap or handle to become detached.

Thus, the prior art polystyrene carriers generally were provided with posts made of metal or other materials of suitable tensile strength. The cost of molding such non-polystyrenic posts to polystyrene carriers is obviously greater than the cost of molding a unitary polystyrene carrier would be.

Accordingly, it will become apparent that a carrier comprising a unitary polystyrene container having polystyrenic posts to which a carrying strap or handle can be attached without fear of inadvertent detachment would be advantageous to packaging engineers and others involved in the container art.

SUMMARY OF THE INVENTION

The primary object of the present invention, therefore, is to provide an improved polystyrene carrier which will be free from the aforementioned and other disadvantages of prior polystyrene carriers. Another object of the present invention is to provide a polystyrene carrier which is more easily constructed and less expensive to manufacture than such prior art carriers.

In accordance with these and other objects, there is provided by the present invention a carrier comprising a unitary expanded rigid polystyrene plastic container having a cavity for objects to be contained therein and a pair of posts extending divergently out from the container in non-vertical directions. The posts are adapted to receive a carrying strap or handle which is affixed substantially at each end thereof to one of the posts substantially perpendicular to the axis of that post. Thus, when the strap or handle is lifted vertically the reaction force transmitted to each of the posts is perpendicular to the axis of the post and causes the polystyrene post to be compressed rather than expanded.

A preferred embodiment of the present invention provides posts having a D-shaped cross-section and complementary apertures in the carrying strap or handle encompassing the posts. Still another preferred embodiment of the present invention provides an emergency medical kit which is compact, portable, easy and fast to open, able to withstand rough handling and provides total visibility of the objects contained therein without removing the cover therefrom.

BRIEF DESCRIPTION OF THE DRAWING

Other objects and attendant advantages will become obvious to those skilled in the art by reading the following detailed description in connection with the accompanying drawing, wherein like reference characters designate like or corresponding parts throughout the several figures thereof and wherein.

DETAILED DESCRIPTION OF THE INVENTION

Figure 1:
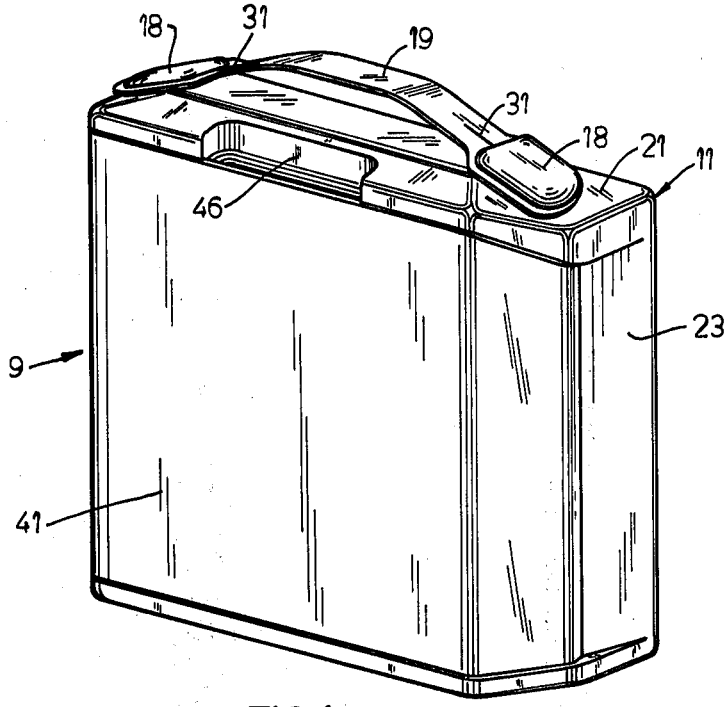
FIG. 1 is a perspective view of a preferred embodiment of the polystyrene carrier of the present invention showing the front, top and right side thereof.
Figure 2:
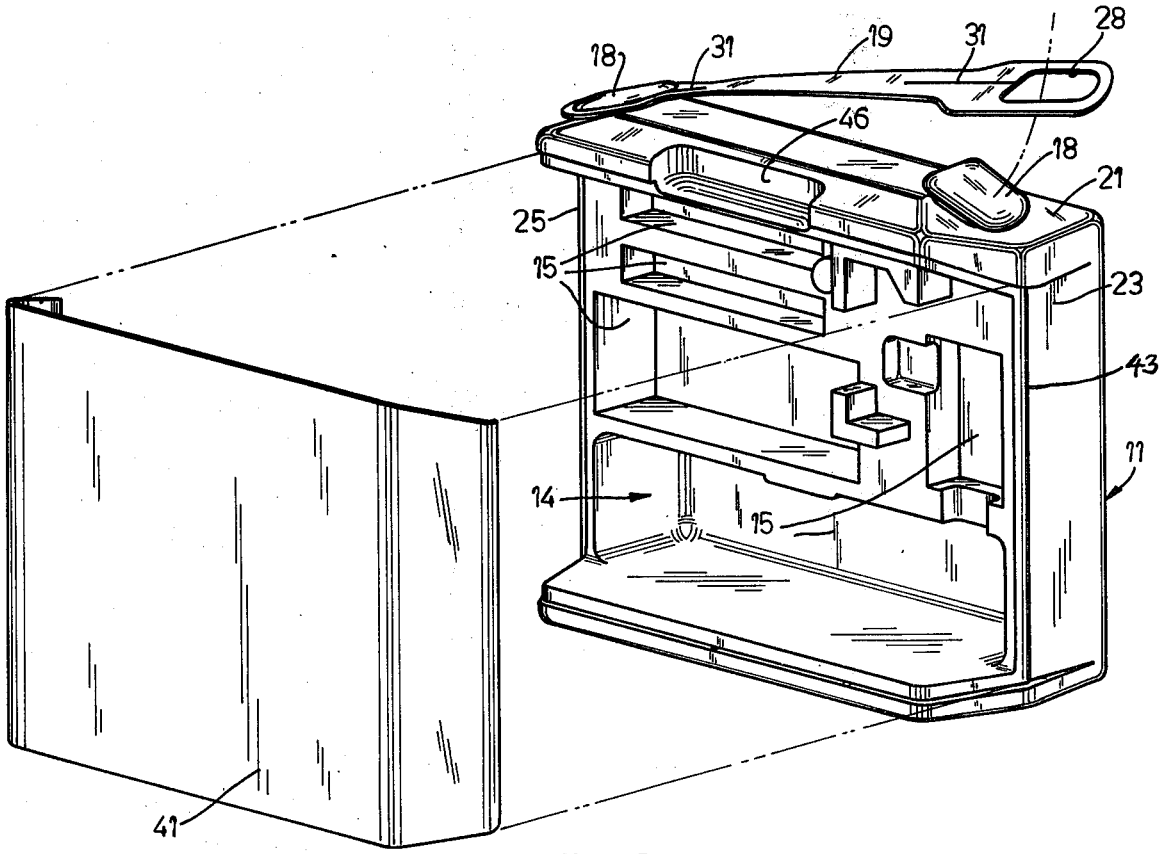
FIG. 2 is an exploded view of the carrier described in FIG. 1.
Figure 4:
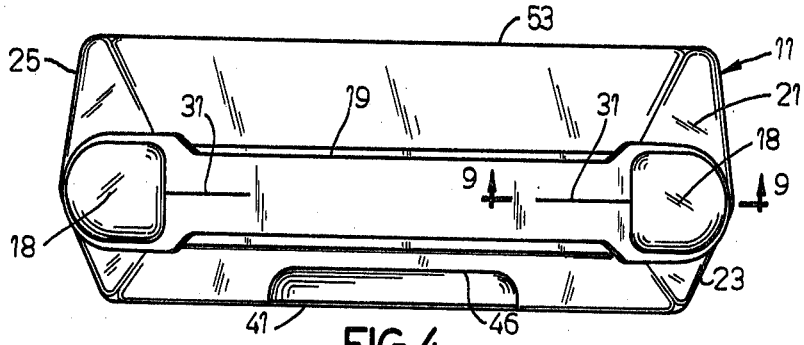
FIG. 4 is a top plan view thereof.
Figure 9:
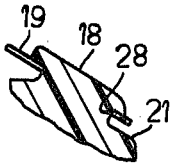
FIG. 9 is a cross-sectional view of the posts and carrying strap or handle thereof taken along line 9—9 in FIG. 4.
Figure 3:
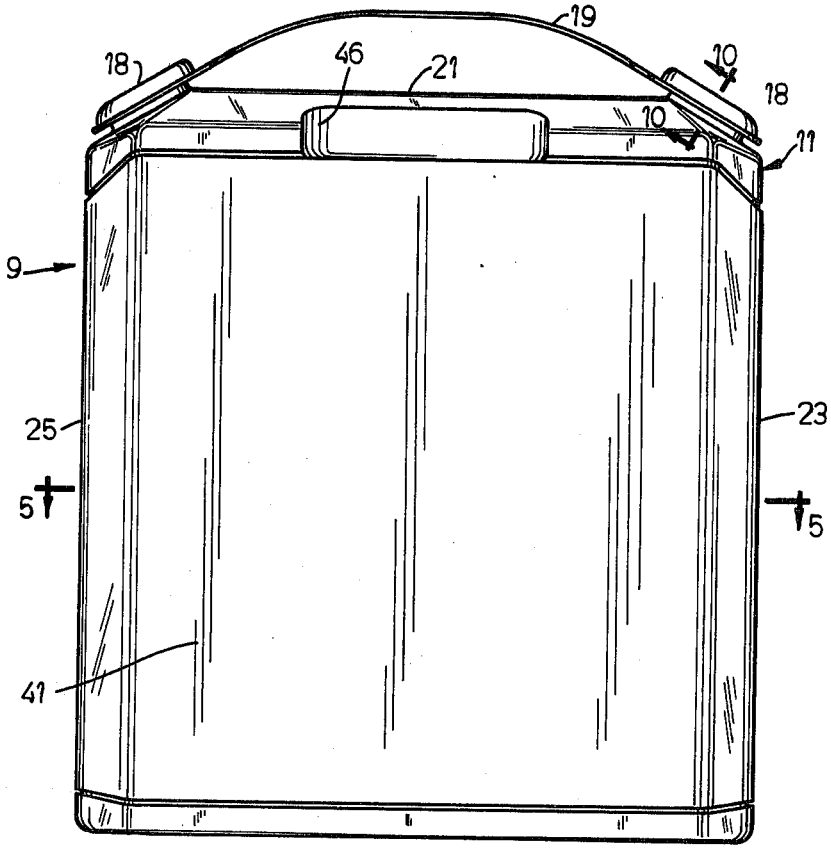
FIG. 3 is a front elevational view thereof.
Figure 10:
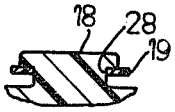
FIG. 10 is a cross-sectional view of the posts and carrying strap or handle taken along line 10—10 in FIG. 3.
Figure 5:
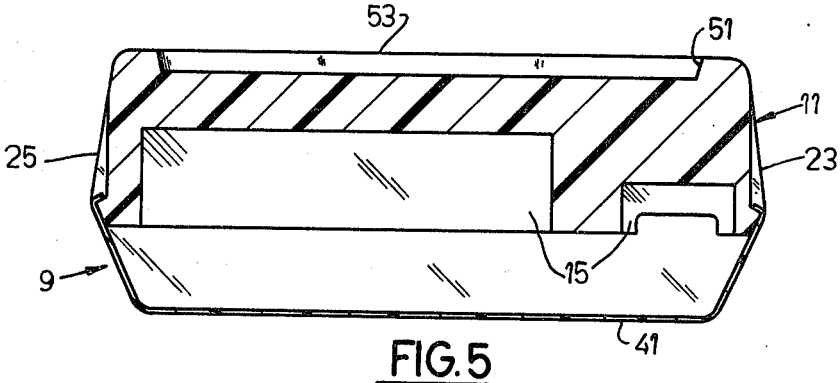
FIG. 5 is a cross-sectional view thereof taken along the line 5—5 in FIG. 3.
Figure 8:
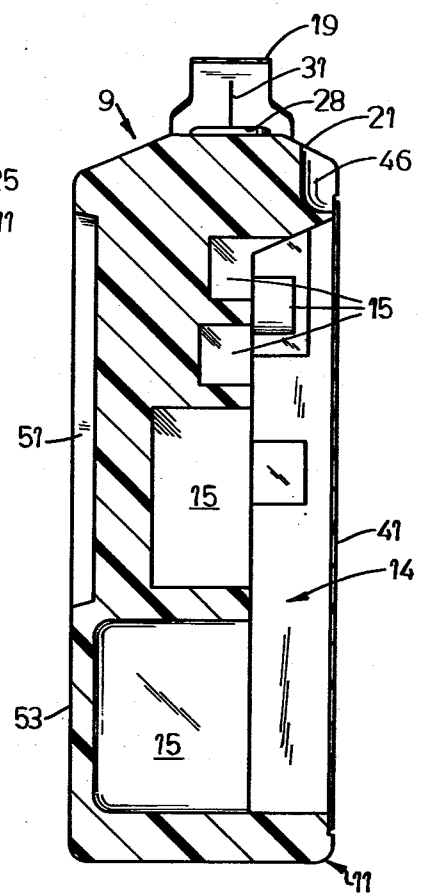
FIG. 8 is a cross-sectional view thereof taken along the line 8—8 of FIG. 6.
Figure 6:
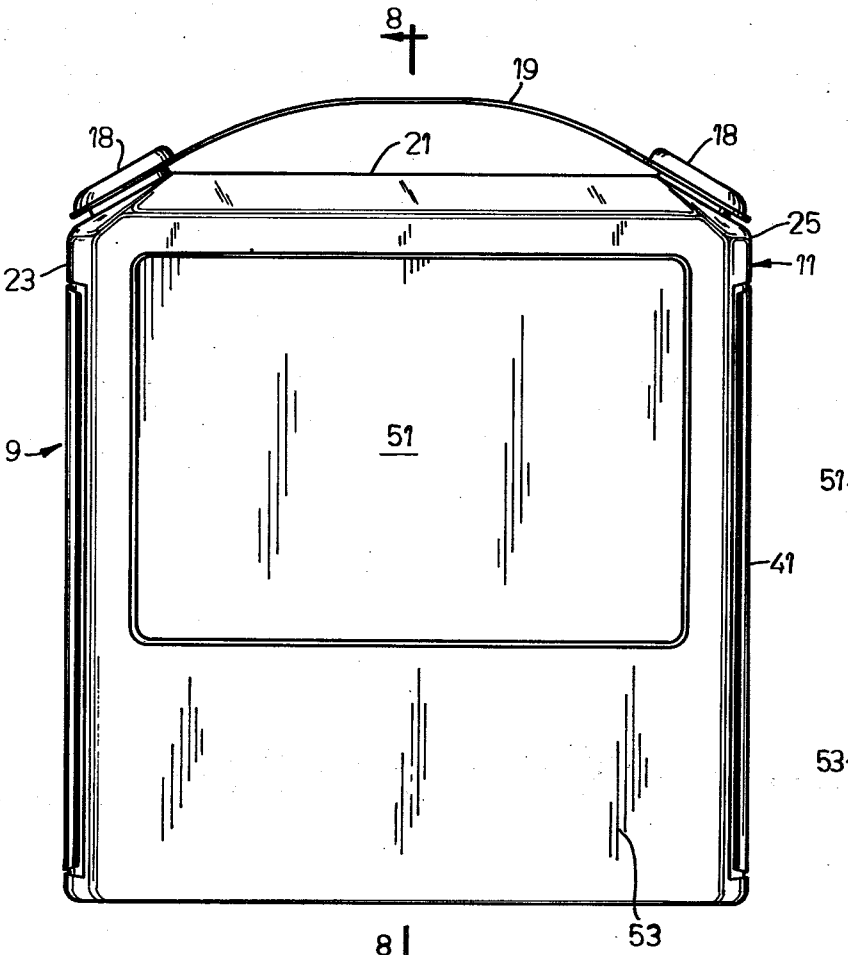
FIG. 6 is a back elevational view thereof.
Figure 7:
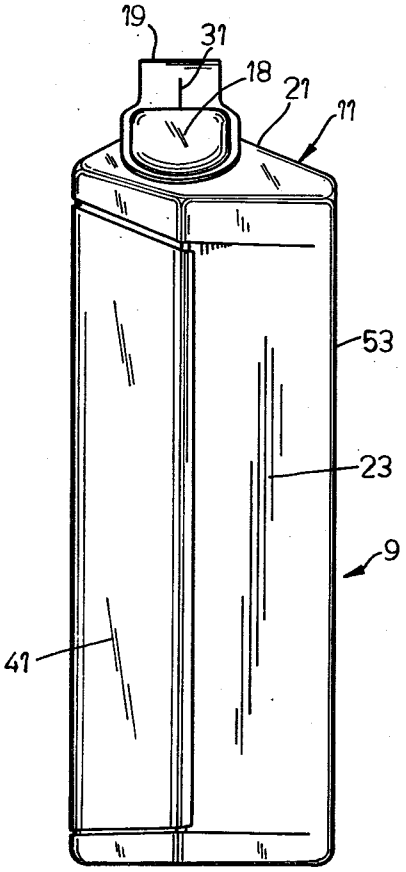
FIG. 7 is a right side elevational view thereof.

Referring to the drawing, there is shown generally in FIG. 1, a carrier 9 comprising a unitary expanded rigid polystyrene plastic container 11 having a generally shown cavity 14 for objects to be contained in carrier 9. Preferably, cavity 14 can have a plurality of compartments 15 having various configurations adapted to contain specific articles in carrier 9, as best seen in FIG. 2, but it will be obvious that carrier 9 can consist of a single compartment, if so desired. Likewise, it will be apparent that the configurations of the compartments 15 of cavity 14 can be circular, square, rectangular, triangular, etc. in conformance with the configuration of the objects to be contained therein.

Unitary container 11 has polystyrene posts 18 extending divergently out from container 11 in nonvertical directions. Posts 18 are adapted to receive a carrying strap or handle 19 for carrier 9. Carrying strap or handle 19 is affixed substantially at each end thereof to one of the posts 18 substantially perpendicular to the axis of each post.

Preferably, posts 18 extend upwardly from oblique portions of top wall 21 of container 11. However, posts 18 can extend from side walls 23 and 25, if so desired, provided that carrying strap or handle 19 is affixed to each post substantially perpendicular to the axis thereof. The angle between the axes of posts 18 can be from 30° to 180°.

Preferably, each post 18 has a substantially D-shaped cross-section with an increased diameter or head at its outer end. While the increased diameter can likewise have a D-shaped cross-section, it can have another configuration, if so desired. Advantageously, the substantially D-shaped cross-section of posts 18 provides the maximum load-bearing surface for carrying strap or handle 19 on the curved portions of the D, while minimizing the amount of polystyrene required in posts 18 on the flat, non-load-bearing portions thereof.

Carrying strap or handle 19, preferably, is made of high density polyethylene and has apertures 28 substantially at each end thereof and complementary to posts 18. Advantageously, carrying strap or handle 19 can have slits 31 which allow apertures 28 to be placed over the increased diameter of posts 18. Other configurations of carrying strap or handle 19 and the method of its attachment will be readily apparent, but the force transmitted to each post 18 when container 11 is lifted vertically by carrying strap or handle 19 must be perpendicular to the axis of each post 18.

Container 11 is molded according to conventional techniques for molding expanded rigid polystyrene plastics in a two-part mold. However, the preferred embodiment of container 11, shown in the drawing hereof, provides novel undercut portions in posts 18 and below rims 43. Undercuts are not generally molded into polystyrene objects. Advantageously, the novel undercuts of posts 18 and below rims 43 are achieved by designing the mold so that it parts without engaging posts 18 or rims 43.

The preferred embodiment of the carrier of the present invention, as shown in the drawing, is particularly suited for use as an emergency medical kit. Carrier 9 has a cover 41 forming a front wall and affixed to container 11 over an undercut rim 43 molded on side walls 23, 25 of container 11. Advantageously, cover 41 can be transparent and made of polybutyrate or an acrylonitrile, butadiene, styrene copolymer, thereby allowing its contents to be visually inspected without removing the cover. To facilitate rapid removal of cover 41 from carrier 9 in an emergency, container 11 can have a recessed portion 46 in top wall 21.

To maintain the visibility of the contents of carrier 9, the label 51 therefor can be affixed to a recessed portion in the back wall 53 of container 11. The recessed label 51 further obviates soiling which could occur while the carrier is on its back during assembly, shipping, storage or use.

Having described the invention in specific detail and exemplified the manner in which it may be carried into practice, it will now be readily apparent to those skilled in the art that innumerable variations, applications, modifications and extensions of the basic principles involved may be made without departing from its sphere or scope.

That which I claim is:

1. A carrier useful for an emergency medical kit comprising:

a unitary expanded rigid polystyrene plastic container having top, bottom, back and side walls forming a cavity having a plurality of compartments for objects to be contained therein, a transparent cover over said cavity providing a front wall removably affixed to an undercut rim on each of said side walls of said container, a recessed area in said top wall adapted to facilitate the easy removal of said cover from said container, a recessed area in the outer surface of said back wall adapted to receive a label and allow said carton to be placed on its back without soiling the label, while maintaining total visibility of said objects in said container through said cover, a pair of relatively thick expanded rigid polystyrene posts extending divergently up from said top wall of said container in nonvertical directions and adapted for receipt of a carrying strap or handle for said container, the axes of said posts intersecting at an angle of 30° to 90° therebetween, said posts having an arcuate shape at one side and a substantially linear surface opposite thereto, said linear surfaces of each said post facing each other, and said posts having an increased diameter at their upper free ends, and a carrying strap or handle having an aperture substantially at each end thereof complementary to the configuration of said posts and encompassing one of said pair of posts substantially perpendicular to the axis thereof, whereby the force transmitted to each said post when said container is lifted vertically by said carrying strap or handle is perpendicular to said axis of each of said posts to compress each of said posts radially inward.

2. The carrier defined in claim 1, wherein said cover is made of polybutyrate.

3. The carrier defined in claim 1, wherein said cover is made of acrylonitrile, butadiene and styrene copolymers.

4. The carrier defined in claim 1, wherein said carrying strap or handle is made of high density polyethylene.

5. The carrier defined in claim 1, wherein said posts extend perpendicularly from oblique portions of said top wall.

* * * * *